US007031634B2

(12) United States Patent
Ziegelmuller et al.

(10) Patent No.: US 7,031,634 B2
(45) Date of Patent: Apr. 18, 2006

(54) BLADE CLEANER CARTRIDGE WITH DUST AND LINT SEAL BLADE

(75) Inventors: Francisco L. Ziegelmuller, Penfield, NY (US); Carol K. Dunn, Rochester, NY (US); Maria B. Carrone, Churchville, NY (US); Kenneth J. Brown, Penfield, NY (US); Douglas C. Anderson, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 199 days.

(21) Appl. No.: 10/703,885

(22) Filed: Nov. 7, 2003

(65) Prior Publication Data

US 2004/0156650 A1 Aug. 12, 2004

(51) Int. Cl.
*G03G 21/00* (2006.01)

(52) U.S. Cl. ..... 399/102; 399/350; 399/351

(58) Field of Classification Search ..... 399/98, 399/99, 101, 102, 123, 297, 350, 351
See application file for complete search history.

(56) References Cited

U.S. PATENT DOCUMENTS

| | | | | |
|---|---|---|---|---|
| 4,516,850 | A * | 5/1985 | Nishikawa | 399/350 |
| 4,527,887 | A * | 7/1985 | Vineski | 399/102 |
| 4,866,483 | A | 9/1989 | Davis et al. | |
| 5,426,485 | A | 6/1995 | Fujita et al. | |
| 5,442,422 | A * | 8/1995 | Owens, Jr. et al. | 399/350 |
| 5,991,568 | A | 11/1999 | Ziegelmuller et al. | 399/102 |
| 6,044,245 | A * | 3/2000 | Kabashima et al. | 399/350 |
| 6,075,965 | A | 6/2000 | Tombs et al. | 399/308 |
| 6,453,134 | B1 | 9/2002 | Ziegelmuller et al. | 399/101 |

* cited by examiner

*Primary Examiner*—William J. Royer
(74) *Attorney, Agent, or Firm*—Lawrence P. Kessler

(57) ABSTRACT

In an apparatus for cleaning particulates from a moving web, a dust seal blade assembly which is easily mounted to a cleaning blade to reduce internal dusting in a cleaner apparatus and for trapping of lint, paper dust, or fibrous material and which might also reduce the effects of oil contamination. The arrangement provides a low-cost, operator-replaceable cartridge having one or more wiper blades with at least one of them having the dust seal blade assembly and enclosed within a particle sump assembly that is easily removed from association with the web being cleaned.

10 Claims, 10 Drawing Sheets

BLADE CLEANER CARTRIDGE WITH DUST AND LINT SEAL BLADE

CROSS-REFERENCE TO RELATED APPLICATION

Reference is made to the following commonly assigned application, the disclosure of which is incorporated herein by reference:

U.S. patent application Ser. No. 10/625,423, filed on Jul. 23, 2003 (U.S. Publication Number 2004-0120728-A1, published on Jun. 24, 2004), in the names of Francisco L. Ziegelmuller, et al., entitled: WEB-CLEANING APPARATUS FOR ELECTROSTATIC PRINTER/COPIER, now abandoned.

FIELD OF THE INVENTION

This invention relates generally to improvements in cleaning apparatus of the type used, for example, in electrostatic document printers or copiers to remove residual toner, carrier, dust, lint, paper fibers and the like from a moving surface, typically in the form of an endless web or drum.

BACKGROUND OF THE INVENTION

There are numerous cleaning devices that have been employed within the electrographic industry for copier and printer apparatus to remove particulate material, such as toner, carrier, dust, lint, paper fibers, and the like, from various moving surfaces within the apparatus. These surfaces typically include the relatively delicate outer surfaces that function as image-recording and image-transfer elements, as well as the somewhat less delicate surfaces of endless webs that transport sheet material from one image processing station to another.

Blade cleaners are often classified by the way they operate to clean the moving surface they contact. Some operate in a "scraping" mode; others operate in a "wiping" mode. When operating in a scraping mode, the blade element is set at an obtuse angle (typically between 100° and 120°) relative to the oncoming surface it is intended to clean; thus, the blade edge opposes the movement of the surface and deflects particulate material from the surface as it initially engages the blade edge. When operating in a wiping mode, the blade element is set at an acute angle (typically between 60° and 85°) relative to the oncoming surface it is to clean; thus, the blade edge extends slightly in the direction of travel of the moving surface, and particles are wiped from the surface as the web moves away from the blade edge. The scraping mode is harsher on the moving surface and usually requires a lubricant to prevent the blade from becoming unstable and tucking under. In applications where considerable amounts of toner (which serves as a blade lubricant) remain on a surface for cleaning, scraping blades are often preferred since they are more flexible to machine configuration. In applications that require long runs without toner or any other self-lubricating material, wiper blades are preferred due to their inherent stability. Both types of blade cleaners (scrapers and wipers) are disclosed in U.S. Pat. No. 5,426,485 in the names of Fujita, et al., issued Jun. 20, 1995, in which cleaning blades serve to remove particulate material from an endless elastic belt used to convey copy sheets in an electrostatic copier. In this patent, the pressure applied by the blade is adjustable as a function of belt temperature.

U.S. Pat. No. 4,866,483, in the names of Davis, et al., issued Sep. 12, 1989, discloses a blade-type cleaning station for an electrostatic printer having a pair of spaced, parallel cleaning blades, that are set to operate in a wiping mode and serve to remove residual toner from an endless photoconductive image-recording belt once a toner image has been transferred to a copy sheet. The cleaning station further includes a rotatably driven auger for transporting most of the scavenged residual toner collected in a sump to a remote receptacle for removal. The cleaning station is stationary within the printer's base frame, and the entire print engine, including the image-recording belt, is mounted on a pivoting frame for movement between closed and open positions, towards and away from the cleaning station. In its closed position, the print engine's image-recording belt pressingly engages the respective edges of the cleaning blades and is thereby positioned to be cleaned by the blades as the belt advances along its endless path. In its open position, the belt is sufficiently spaced from the blades so that the cleaning station may be readily serviced (by vacuuming scavenged toner from that portion of the sump directly beneath the cleaning blades) or to provide for replacement of the cleaning blades themselves. The blades are loosely supported at opposite ends in a pair of guide channels formed in the end walls of the sump housing. Each blade has a pair of downwardly depending pegs at opposite ends. These pegs fit into the central portion of a coil spring located in each guide channel, such coil springs acting to urge the blades into contact with the moving belt when the print engine frame has been returned to its closed position. In use, the cleaning blades operate on an unsupported region of the image-recording belt.

The cleaning station disclosed in U.S. Pat. No. 4,866,483 provides certain advantages that were not found previously within the prior art, however, problems still exist in certain respects. For example, the sump housing that receives the toner that has been wiped from the belt surface by the blade cleaners is relatively small, thereby requiring the relatively costly auger system to continuously transport particles to a remote location for storage prior to removal. Furthermore, while ready access may be gained to the cleaning station by simply pivoting the print engine frame to its open position, there is no fool-proof way of removing the scavenged particulate material from the sump blade without some potential for blowing the particles throughout the machine frame. Once the print engine has been pivoted to its open position to gain access to the scavenged particle sump for vacuuming, the entire sump is exposed to ambient air, allowing any air currents near the open sump to blow toner or other particulate matter throughout the instrument. Ideally, the scavenged particle sump should be easily removable from the machine frame with scavenged particles remaining confined therein. Once removed, the sump may be discarded and replaced with a new sump, or it may be cleaned at a location safely spaced from the machine and then replaced. Also, since there is no lid or cover on the top of the sump, scavenged particles can escape the sump and contaminate the machine elements while the machine is in operation. Moreover, since there is no hard backup for the web to resist the pressure applied by the cleaning blades, the web is likely to stretch over time, changing the dynamics at the blade edge/web interface.

U.S. Pat. No. 6,453,134, in the names of Ziegelmuller, et al., issued Sep. 17, 2002, discloses an improved blade cleaner having a lid to isolate the removed scavenged particles so that they can not escape the sump and contaminate the machine elements while the machine is in operation, however, U.S. Pat. No. 6,453,134 does not disclose any techniques for simple and easy removal and replacements of the sump assembly.

U.S. Pat. No. 5,991,568, in the names of Ziegelmuller, et al., issued Nov. 23, 1999, discloses a dust seal blade that can be used with either a wiper or a scraper-cleaning blade to increase the effectiveness of the cleaner for dust and lint by allowing toner to build up within the cavity formed by the dust seal blade, the cleaning blade and the surface being cleaned. U.S. Pat. No. 5,991,568 applies a blade with a cavity for a single blade cleaner. Additionally, U.S. Pat. No. 5,991,568 discloses a few techniques for implementing the dust seal blade with a cavity, however, U.S. Pat. No. 5,991,568 does not address the issues presented in a wiper blade configuration. Therefore, there remains a need within the art for an apparatus and an easier method for manufacturing, assembling and servicing wiper blade configurations. Additionally, the wiper blade embodiments are difficult to implement and require further robustness for lint removal than is afforded by a dual blade cleaner approach discussed above.

In view of the foregoing discussion, there remains a need within the art for a dust and lint seal blade that is easy to manufacture, assemble and service and which can further increase the performance of the cleaner under a high level of lint contamination, while providing lubrication for the cleaning blade and oil adsorption from the web.

SUMMARY OF THE INVENTION

The present invention addresses the shortcomings within the prior art by providing a dust seal blade assembly which is easily mounted into a cleaning blade to reduce internal dusting in a cleaner and for trapping of lint, paper dust or fibrous material and which might also reduce the effects of oil contamination.

An object of the invention is to provide a relatively low-cost, operator-replaceable cartridge comprising one or more wiper blades with at least one of them having the dust seal blade assembly and enclosed within a particle sump assembly that is easily removed from a printer/copier.

It is an additional object of the invention, to provide a sump assembly in the form of a cartridge that can be serviced away from the machine or, alternatively, discarded and replaced with a new cartridge and that can be easily serviced for worn out parts, remanufactured or recycled.

Still a further object of this invention is to provide an improved method for cleaning particulate material from a moving surface.

The ensuing detailed description of preferred embodiments will make apparent, these and other objects of the invention, in accordance with a first aspect of the invention, by the provision of a web-cleaning apparatus comprising an operator-replaceable cleaning cartridge adapted to be releasably supported by a bracket in a position to engage a moving surface of a web to be cleaned. Such cleaning cartridge comprises (a) a pair of cleaning blades; (b) a dust seal blade assembly with hook features that allows it to be attached to the first cleaning blade; (c) a sump housing for releasably supporting the blades in a spaced parallel relationship, for receiving and storing particulate material removed from the moving surface by the blades, and with supporting features for locating or locking a baffle, and for latching onto a lid; (d) a baffle to provide a barrier to waste toner outflow within the sump and having holes to locate and lock it to the sump housing; (e) a foam gasket that seals along the perimeter of the interface between the sump and lid; and (f) a lid assembly, operatively connected to the sump housing by cutout slots that mate with tab features on the sump housing to form a substantially enclosed chamber therewith by a foam gasket. The sump housing has a pair of opposing end walls, each defining a pair of spaced notches for receiving and supporting an end of one of the blades. The notches are positioned to locate the respective edges of the blades in a spaced, parallel relationship, with each of the flexible blades extending at a predetermined acute angle relative to a planar upper surface of the lid assembly. The lid assembly comprises a lid member defining an elongated opening through which the flexible blade members of the wiper blades and the dust seal blade project when the wiper blades are supported in the notches of the sump housing. The opening in the lid has a rectilinear lip supporting a flexible seal blade having a rectilinear edge spaced from said wiper blades and extending parallel thereto. The seal blade and the dust seal blades are substantially more flexible than the flexible blades of the wiper blades and, in addition to sealing the upstream end of the sump housing to prevent the escape of scavenged particles, also operate to deflect into the enclosed chamber particulate material wiped from a moving surface by at least one of the wiper blades. Preferably, the lid member defines an open auxiliary reservoir for receiving any particulate material wiped from the moving surface by the seal blade. Also preferred, is that the upper surface of the lid member supports at spaced, parallel locations, two strips of a compressible material which cooperate with the moving surface to prevent particulate material in the sump from escaping from the sides of the sump housing. The cartridge is easily accessible to the operator by using a bracket latched in a releasable manner to a hard backup shoe assembly that can be quickly unlatched and dropped for easy installation, service and removal of the cleaning cartridge. The cartridge-supporting bracket can also be quickly removed from the backup shoe assembly for installation or removal of a transport or transfer web.

In accordance with another aspect of the invention, the web-cleaning apparatus of the invention comprises, in addition to the above-noted cleaning cartridge, a hard back-up member or "shoe" that is positioned on the opposite side of the moving web from the wiper blades of the blade cleaner cartridge. Preferably, the back-up member is part of a two-piece bracket assembly used to releasably support and position the cleaning cartridge relative to the web surface and a backup shoe or pressure plate in order to achieve a uniform pressure across the web.

Due to the construction of the operator-replaceable cleaning cartridge, a machine operator can perform periodic maintenance on the cleaner station with minimum downtime. The application of the blade cleaners against a stationary hard backup minimizes any adverse effect the cleaner might have on the web-tracking system or on color registration. The stationary backup does not steer the web and the blades are designed with enough compliance to reduce load variations due to differential in engagement between front and rear of the cleaner as found in other applications where the cleaner blades abut against a roller and the blades are considerably stiffer. The auxiliary waste reservoir in the lid assembly serves to contain any particles that re-deflected upstream of the cleaning blades. The first blade to contact the web does the bulk of the cleaning work, however, the dust seal blade assembly is the first trap for lint and toner dust via toner build up within the cavity formed by the web, the dust seal blade assembly and the first cleaning blade. Toner build up in the cavity also helps in adsorbing oil contamination from the web surface. Lint must overcome the dust seal blade and the toner trapped within its cavity before reaching the first blade, which also functions for trapping paper dust, fibers, lint and oil from the transport web. The second blade continues the cleaning process, extending the effectiveness of the cleaner for a longer time. The dual wiper blades with the dust seal blade assembly featured on the first blade ensure consistency and extended life cleaning performance while avoiding the problems of instability or tuck under encountered with scraper blades. The efficiency of the first blade used in conjunction with the dust seal blade in trapping fibers, lint and other debris is so substantial that it effectively eliminates the need for a fur brush in the cleaner.

The cleaning function of the dust seal blade assembly can be enhanced by periodically, and particularly at installation, running a service routine to introduce toner to the web, which will fill the cavity, defined by the dust seal blade assembly, the web, and the cleaning blade.

The invention and its advantages are better described by the ensuing detailed description of preferred embodiments, reference being made to the accompanying drawings in which like reference characters denote like parts.

BRIEF DESCRIPTION OF THE DRAWINGS

The invention and its objects and advantages will become apparent upon reading the following detailed description and upon reference to the drawings, in which.

DETAILED DESCRIPTION OF THE INVENTION

The preferred embodiment, as described herein, is not intended to disclose all possible variations of the invention, and it should be understood that the described embodiments are only examples of the invention. The scope of the invention is determined by the appended claims. The cleaning apparatus of the invention is adapted for use in an electrostatic printing machine to clean marking particles (toner) and other particulate material. The invention is particularly well adapted for systems employing an endless web used to transport image-receiver sheets. It will be evident from the ensuing description that the invention is equally well suited for use in a wide variety of devices to clean particulate material from different types of moving surfaces.

Figure 1:
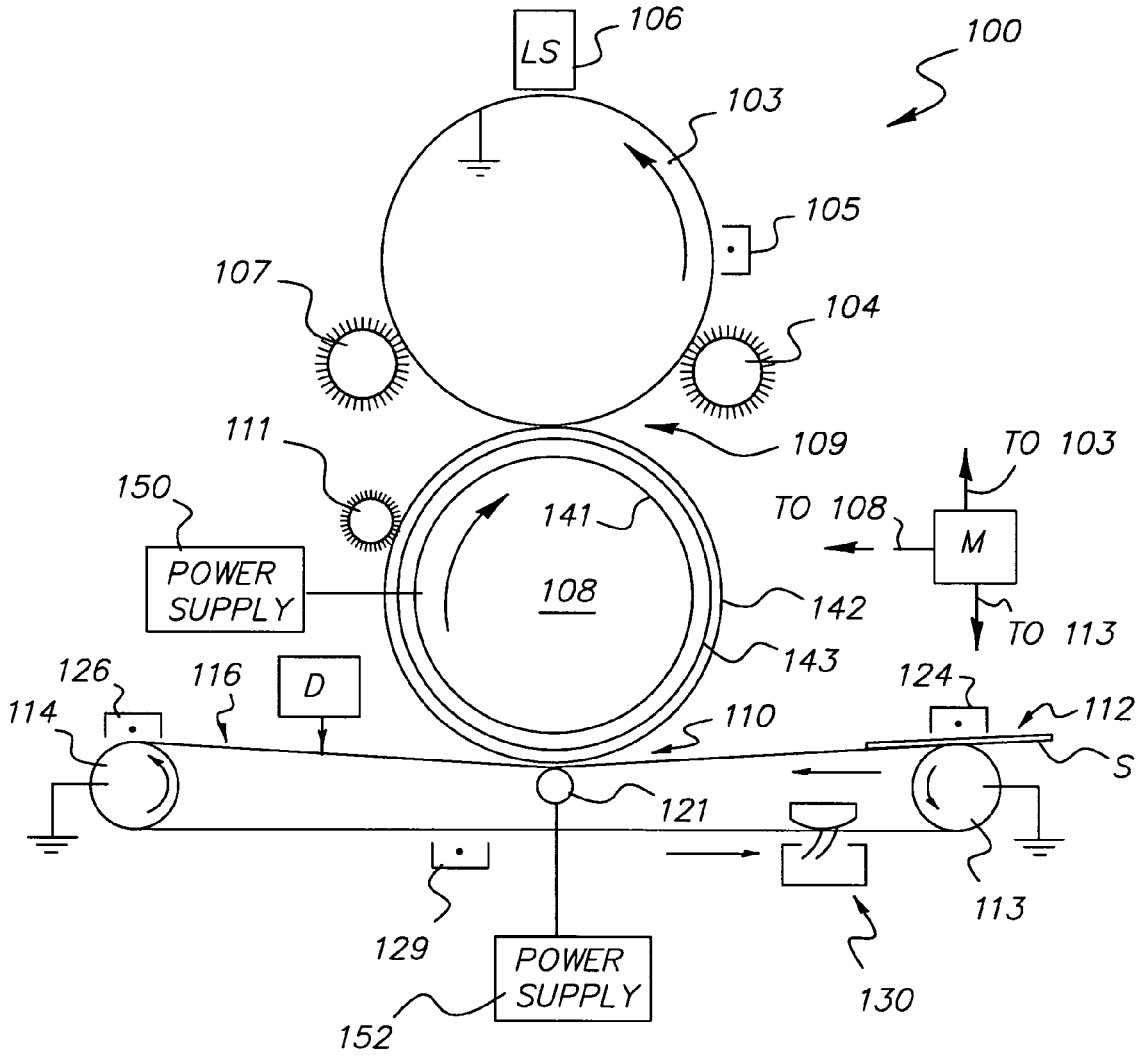
FIG. 1 is a schematic illustration of an electrostatic document printer in which the invention is useful and is shown as being embodied.

Referring to FIG. 1, an exemplary electrophotographic document printer 100 is shown having a primary image-forming member 103, for example, a rotatably driven conductive drum having an outer surface of a photoconductive material. One or more transferable toner images are formed on the photoconductive surface of member 103 by first uniformly charging the surface with electrostatic charge provided by a corona charger 105 or the like. The uniformly charged surface is then imagewise exposed to actinic radiation provided, for example, by a laser scanner 106, or any other suitable controlled light emitting device, thereby selectively discharging the charged surface and leaving behind a latent charge image. Finally, the latent charge image is rendered visible (developed) by applying electroscopic toner particles using a magnetic brush applicator 107, or the like. In some printers of this type, a series of toned process control patches (images) are also formed on the surface of the image-recording element, such patches being located in the interframe region between successive image frames.

The above-noted toner images and toned process control patches are then transferred to an intermediate image-transfer member 108 at a transfer nip 109. Any residual toner on the image-forming member 103 is removed by a cleaning brush 104 prior to recycling the image-forming member 103 through the image-forming process. The intermediate image-transfer member 108 may include, for example, an electrically conductive drum 141 having a compliant blanket 143 with a relatively hard overcoat 142. The conductive drum is electrically biased by a power supply 150. The toner images transferred onto intermediate image-transfer member 108 are then re-transferred to an image-receiver sheet S at a second image-transfer nip 110 formed by a relatively small transfer roller 121 and an endless sheet-transport web 116 made of a dielectric material such as a polymer compound. The toner images are electrostatically attracted to the image-receiver sheets by a suitable electrical bias applied to transfer roller 121 by a power supply 152. A cleaning brush 111 removes residual toner on intermediate image-transfer member 108.

The image-receiver sheets are presented to the endless transport web 116 at a sheet-feed station 112. Web 116 is trained around a pair of rollers 113 and 114, and a motor M serves to drive roller 113 in the direction indicated by the associated arrow. Motor M also serves to rotatably drive the image-recording and image-transfer drums. Suitable sensors and micro-processor based logic and control device (not shown) provide timing and operation of the various components to properly form the developed image on the receiver members. The image-receiver sheets (e.g., paper or plastic) attach to web 116 at a corona charging station 124, which operates to charge the top surface of the sheet so that it becomes electrostatically attracted to the web 116. The grounded rollers 113 and 114 serve to charge the backside of the web 116. A corona charger 126 serves to detack the image-receiver sheets as they wrap around transport roll 114, thereby freeing the sheets for further transport to a toner fusing station, (not shown). It should be noted that any toned process-control patches transferred to the intermediate image-transfer member 108 will re-transfer directly to the transport web 116 in the region between successive image-receiver sheets because they are outside the image frame areas on the image-forming member 103. These toned patches must be removed from the web 116 before receiving a new image-receiver sheet. Otherwise, the toner from these patches will transfer to the rear side of the image-receiver sheets or back to the intermediate image-transfer member 108. An electrophotographic document printer of the type described and shown in FIG. 1 is more thoroughly described in U.S. Pat. No. 6,075,965, issued on Jun. 13, 2000, in the names of Tomb et al., the contents of which are incorporated herein by reference.

The new and improved web-cleaning apparatus 130, according to the invention, removes not only the random toner particles, dust, paper debris, and the like that may accumulate, on the outer surface of the transport web 116 during repeated use of the printing machine described above, but also any relatively heavy deposits of toner that may be transferred to the web 116 for example, as the result of forming the aforementioned process-control patches on the image-forming member 103, paper jams, misregistration of a toner image to the image-receiver sheet and the like. As indicated above, such toned patches (designated as TP in FIG. 3) are formed at predetermined locations on the recording element(s) in the interframe areas and are used, for example, to control registration of multiple color-separated images on the surface of a single image-receiver sheet and/or to monitor the effectiveness of the image-forming process across the width of the recording element. These patches get transferred to the web 116 in the spaces between successive image-receiver sheets and are "read" on the web 116 by a densitometer D located downstream of the image-transfer nip 110. As will be appreciated, all particles on the sheet-bearing surface of web 116 should be removed or cleaned from the web 116 before the web 116 receives a new image-receiver sheet. The web-cleaning apparatus 130 of the invention is particularly well adapted to perform this duty and, as shown, is positioned downstream of a transport web conditioning charger 129 that acts to discharge the web surface to facilitate the cleaning function.

Figure 2:
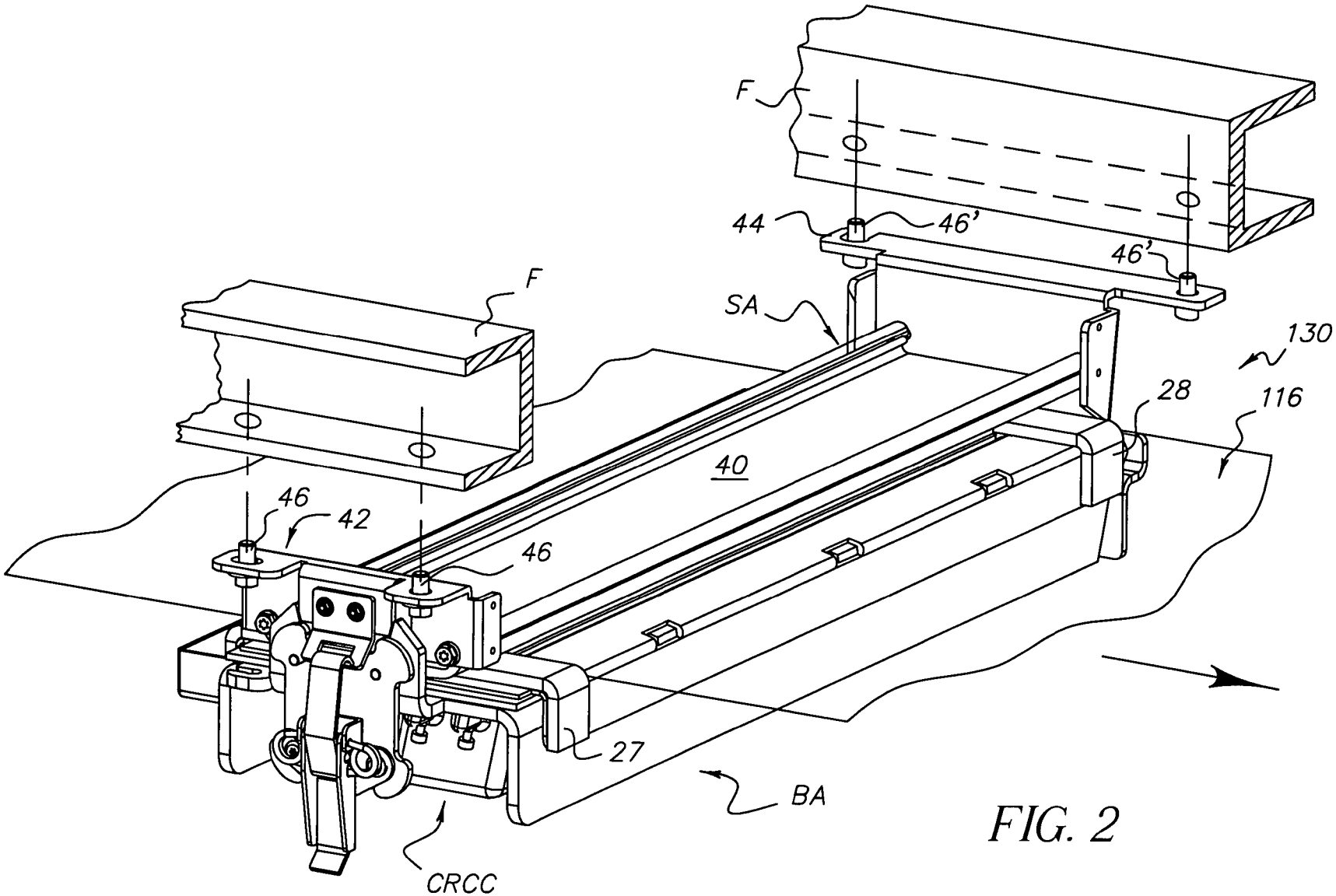
FIG. 2 is a perspective view of a preferred embodiment of the web-cleaning apparatus of the invention, such apparatus shown to be operating on the surface of a sheet-transport web of the FIG. 1 printer.
Figure 3:
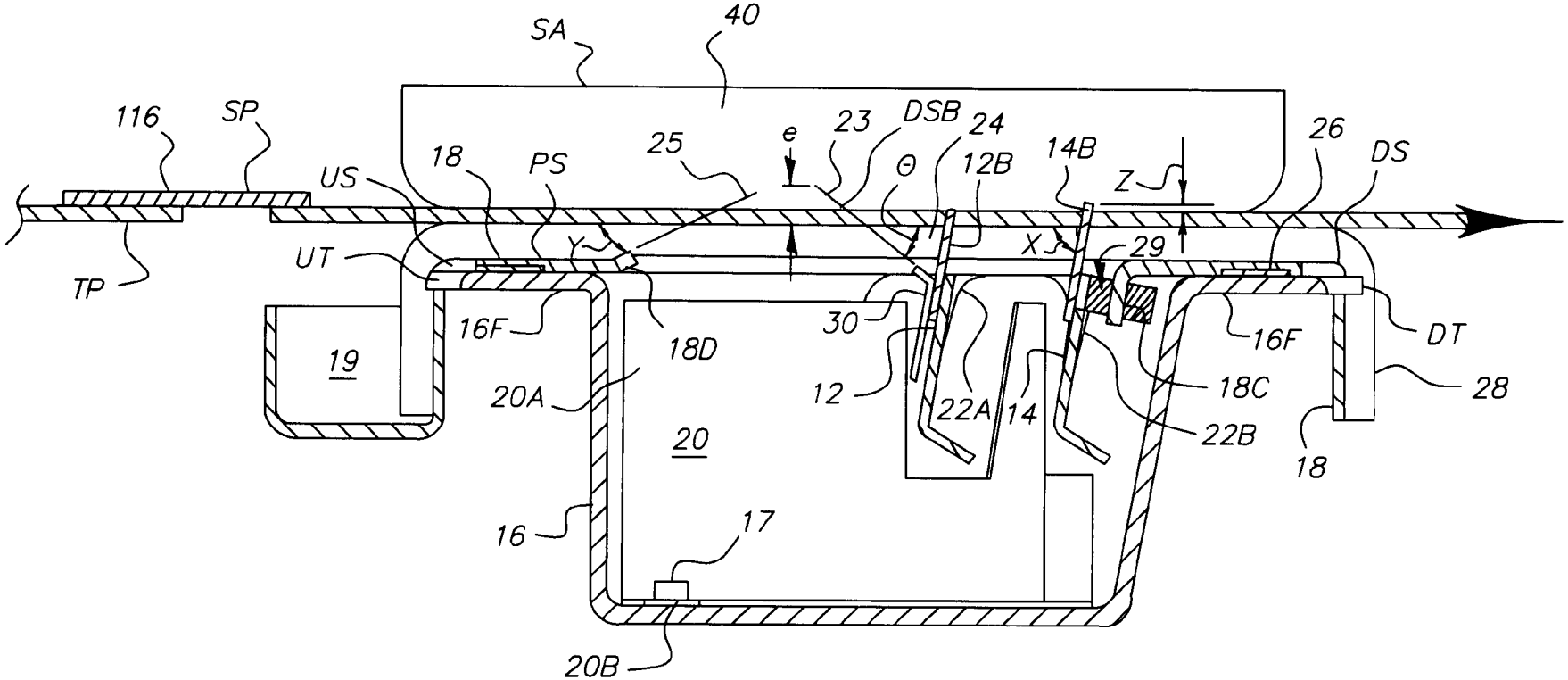
FIG. 3 is a cross-sectional illustration of the FIG. 2 apparatus incorporating the dust seal blade assembly on the first cleaning blade.
Figure 4:
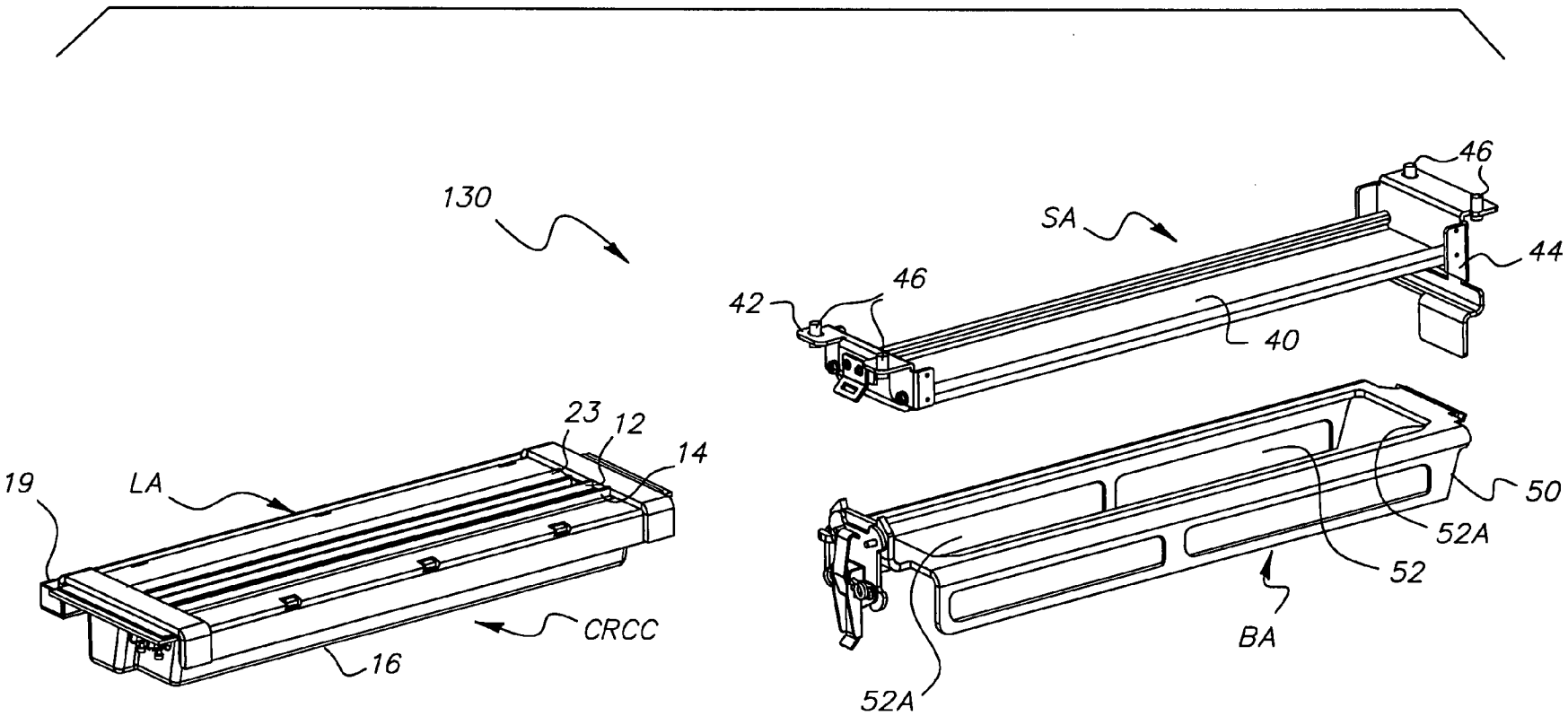
FIG. 4 is an exploded, perspective view of three major components of the FIG. 2 apparatus.
Figure 5:
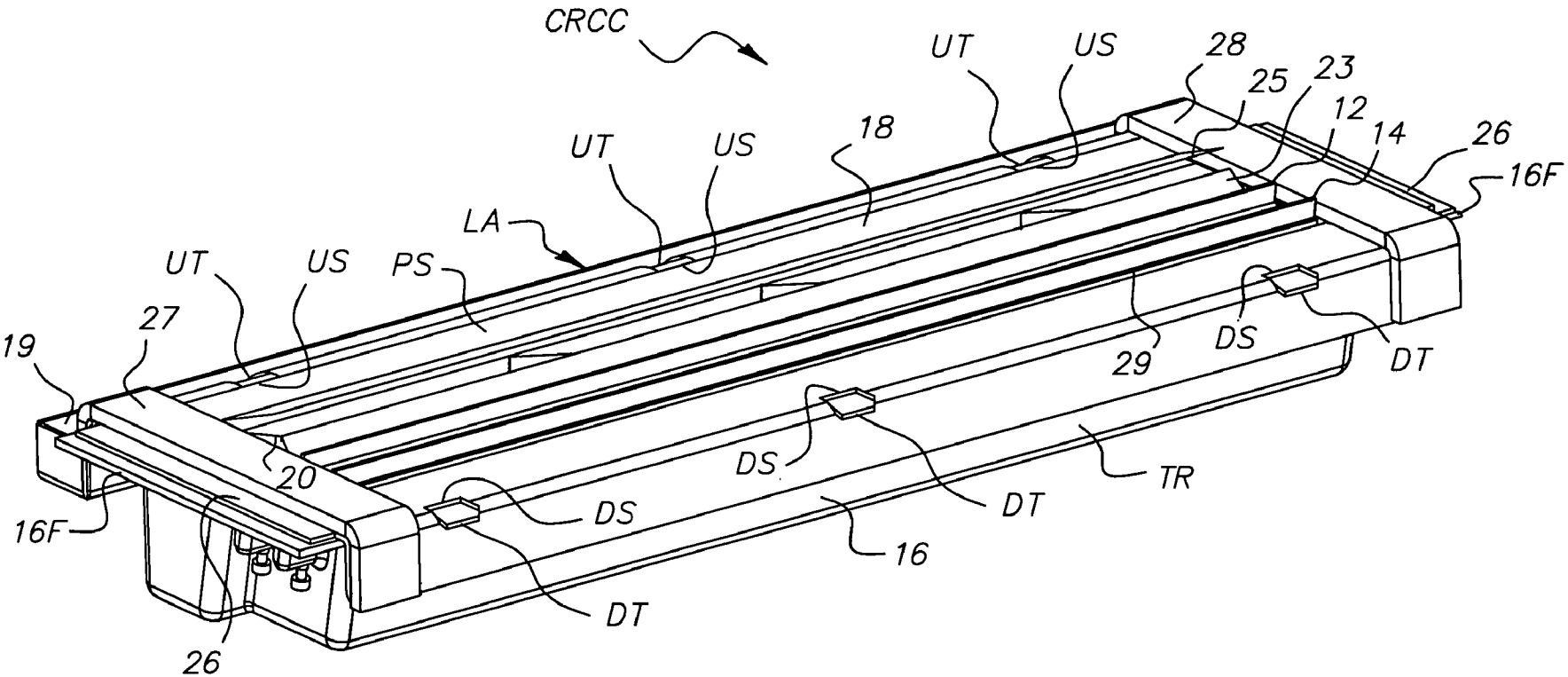
FIG. 5 is a perspective view of the customer-replaceable cleaning cartridge of the FIG. 2 apparatus.

Referring in general to FIGS. 2–6 with particular attention to FIG. 4, the preferred web-cleaning apparatus 130 is shown including three major components. A customer-replaceable cleaning cartridge (CRCC) that provides a web-cleaning function, a bracket assembly BA for releasably supporting the CRCC in an operative position within the printing machine adjacent the web surface to be cleaned, and a back-up shoe assembly SA for providing a hard resistance to the pressure applied on the web 116 by the CRCC. Auxiliary reservoir 19 provides an exterior container for particulate that is trapped outside of the CRCC. As described in commonly assigned U.S. patent application Ser. No. 09/738,751, filed on Dec. 15, 2000, in the names of Francisco Ziegelmuller et al., entitled: SUPPORT FOR BRACKET/BACKUP SHOE ASSEMBLY FOR WEB-CLEANING CARTRIDGE, now U.S. Pat. No. 6,901,227, issued on May 31, 2005, the shoe assembly SA serves to support the bracket assembly BA in a releasable manner. Movement is facilitated between an operative position, in which the bracket assembly BA supports the CRCC in a position engaging web 116, and a service position in which the bracket assembly BA is supported in a position spaced from the web 116 so that the CRCC can be readily removed from the machine and/or serviced. The bracket assembly BA is formed from frame 50 with frame opening 52 and edge features 52A. Shoe assembly SA is formed from hard shoe 40, which provides rigidity for the bracket assembly BA. The shoe assembly SA has front and rear bracket portions 42, 44 to support the bracket assembly BA. The shoe assembly mounting features 46 are formed as slots to facilitate the fastening of the web-cleaning apparatus 130 onto the machine to facilitate web cleaning.

Referring to FIGS. 3, 5, 6, and 8, the CRCC includes a pair of cleaning blades 12, 14 adapted to contact the outer surface of web 116 and to wipe particulate material from the web 116. A dust seal blade assembly DSB is mounted to the first cleaning blade 12 and adapted to contact the outer surface of the web 116 to trap lint type contamination and to reduce toner dusting. Additionally, a cavity 24 formed between the dust seal blade assembly DSB, the cleaning blade 12, and the surface of the web 116, stores toner such that it is in constant contact with the web 116 for oil adsorption and to provide for lubrication with the edge of the cleaning blade 12. A sump housing 16 provides releasable support for the cleaning blades 12, 14 in a spaced parallel relationship that allows for receiving and storing of the particulate material that has been removed or scavenged from the outer surface of web 116 by the cleaning blades 12, 14. A multi-purpose lid assembly LA, attached to the top of the sump housing 16, prevents scavenged particles from escaping the edges of the sump housing 16, and also cleans the edges of the web 116 and collects particles deflected from the web 116 by a seal blade 25 (described below) at a location upstream of the cleaning blades 12, 14. Optionally, the CRCC further includes an internal baffle 20 (shown in FIGS. 3 and 6) that is positioned within the sump housing 16 to prevent any sudden displacement and subsequent spillage of scavenged particles as the aforementioned bracket assembly BA is moved to its service position in which the CRCC can be removed from the machine. Preferably, the sump housing 16, and the baffle 20 are made from an injection-molded plastic having a carbon doping for static dissipative purposes to avoid charge build up. The volume resistivity of the plastic used for the sump housing 16 and the baffle 20 is, preferably, in the range of $10^8$ to $10^{11}$ ohm-cm. Other possible materials, may be metallic, such as aluminum or steel.

Figure 6:
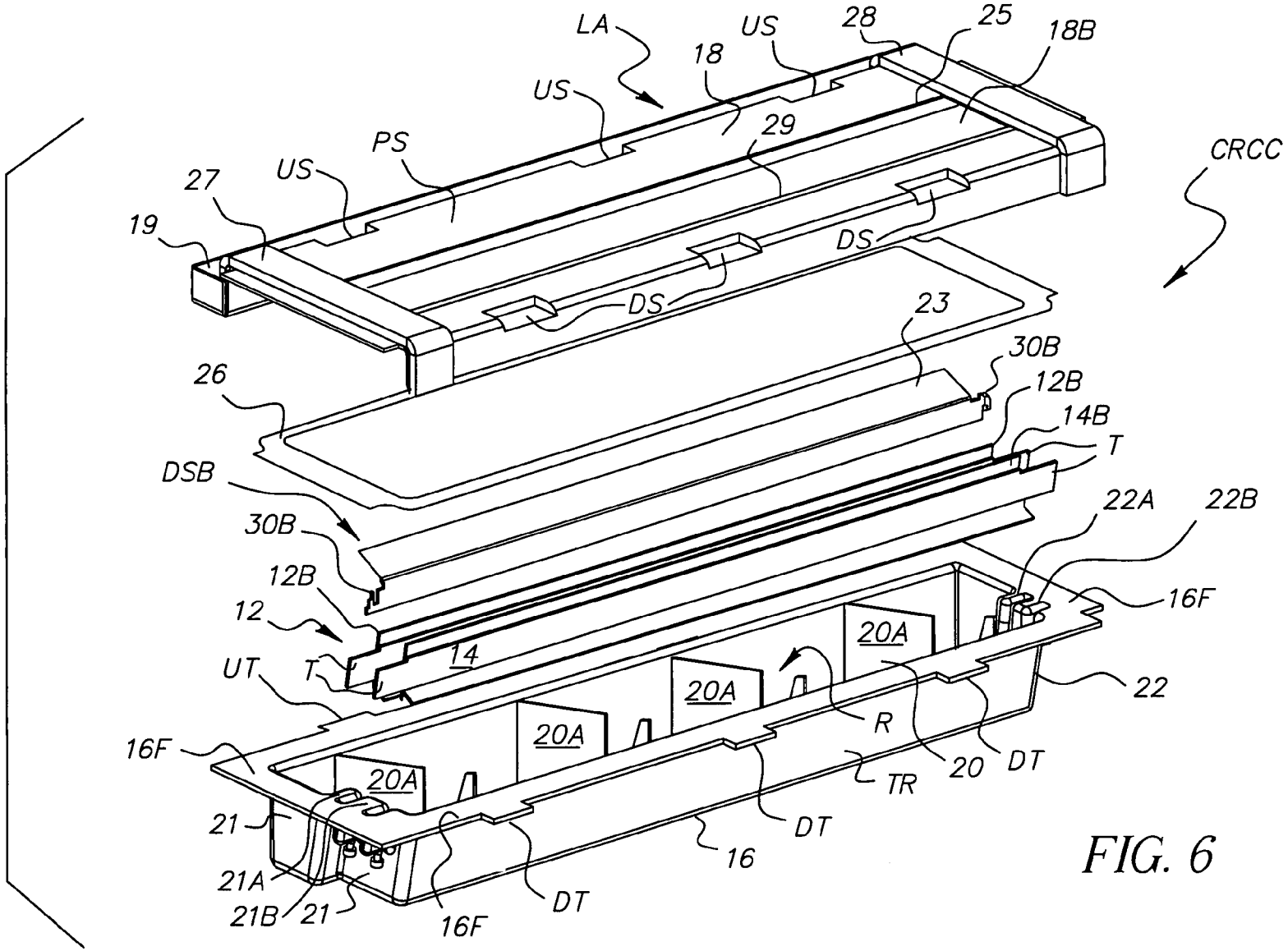
FIG. 6 is an exploded view of the cleaning cartridge shown in FIG. 5.
Figure 7B:
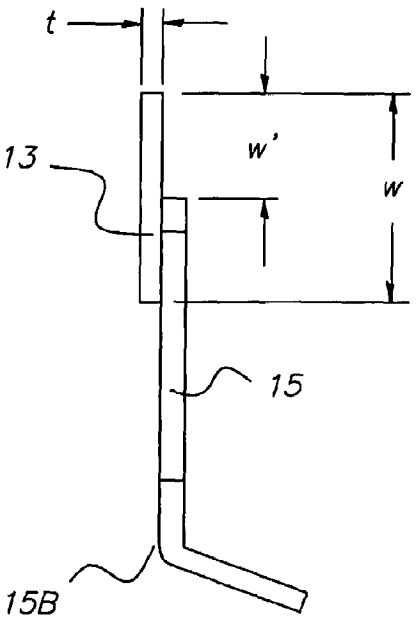
FIGS. 7A and 7B are respective, front and side elevations of a preferred cleaning blade.
Figure 7A:
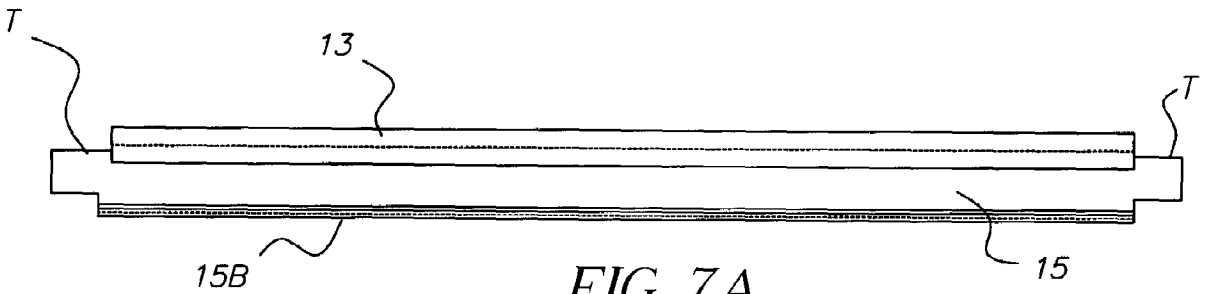

Referring to FIGS. 7A and 7B, each of the cleaning blades 12, 14 includes a flexible blade element 13 and a rigid stiffening plate 15. The flexible blade element 13 is preferably a rectangular slab of polyester polyurethane with the following properties: a hardness of between 60 and 85 Shore A, an initial modulus of between 500 and 1500 psi, a Bayshore resiliency above 30%, and a compression set lower than 25%. The polyurethane slab is fabricated with a thickness t of about 1.27 mm and a width w of 12.7 mm. The length of the respective flexible blade elements may be equal to the width of web 116; preferably, the blades 12, 14 extend about 12 mm to about 25 mm beyond each of the edges of the widest image-receiver sheet size, but within the belt width. The polyurethane slab is glued to the stiffening plate 15, the latter preferably being made of steel, so as to produce a free extension w' of 6.35 mm (see FIG. 7B). In general, the ratio of the polyurethane thickness t to the free extension w' should be in the range of 0.125 to 0.250. As shown, the steel stiffening plate 15 is provided with a bend 15B along one edge thereof, thereby giving the stiffening plate 15 a somewhat L-shaped cross-section. The purpose of the bend 15B is to reduce any bending tendency of the stiffening plate 15 along its length. The bend angle is preferably between 90° and 150°, and it should not provide a barrier to particle flow into the sump housing 16. A pair of opposing extension tabs T is provided on each stiffening plate 15 for mounting the blades 12, 14 on the sump housing 16. Tabs Tare such that they rest on the respective bottom surfaces of a pair of supporting notches formed in the sump housing side walls and support the dust seal blade assembly DSB using hooks 30B (see FIG. 6 and 8A–8D), as described below. When so seated, the cleaning blades 12, 14 are in a locked position relative to the direction of motion of the web 116. Preferably, prior to use, theflexible blade edges are initially dusted with toner, Teflon®, Kynar®, PMMA, zinc stearate or any other suitable dry lubricant to reduce friction with the web 116 at installation.

Referring to FIGS. 8A–8D, the dust seal blade assembly DSB includes a dust seal bracket 30 having an angled tab 30A along its length, two hooks 30B at its ends, and a dust seal blade 23. The dust seal blade 23 has a narrow section with an adhesive for assembling it to the tab 30A on the dust seal bracket 30. The hooks 30B at the ends of the bracket 30 are used to slide the dust seal blade assembly DSB into the first cleaning blade 12 and the hooks 30B provide a small compression force on the thickness of the cleaning blade stiffening plate 15 and the thickness t of the flexible blade element 13 of the cleaning blade 12 to prevent looseness. The lid assembly LA restricts the dust seal blade assembly DSB from coming out of the cleaner cartridge CRCC. The tab 30A is at an angle in the range from 55°–85° to the cleaning blade 12 toallow for the dust seal blade 23 to contact the moving web 116 at an inclination angle θ of 5°–35° (FIG. 3). The dust seal bracket 30 is preferably nonmagnetic stainless steel, but other materials could be used, with a recommended thickness of 0.75 mm–2.54 mm to minimize bowing at center, which could lead to waviness in the dust seal blade 23 and toner leakage from the cavity 24.

Figure 8A:
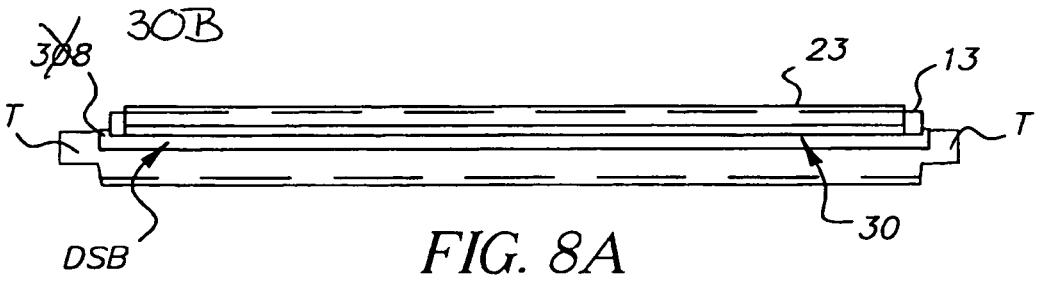
FIGS. 8A, 8B, 8C, and 8D are several views of the cleaning blade, the dust seal blade assembly, their assembly and their mode of operation in the cleaner.
Figure 8B:
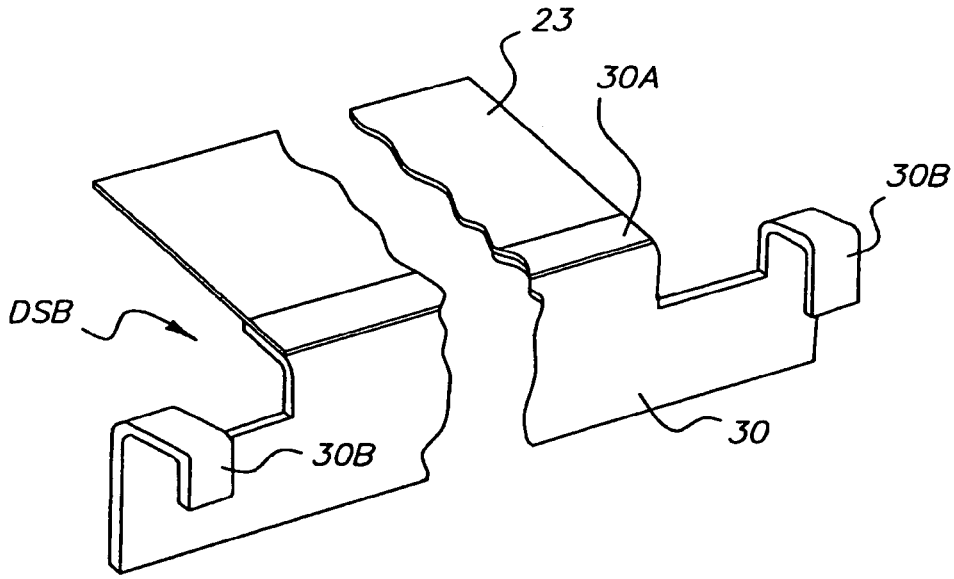
Figure 8C:
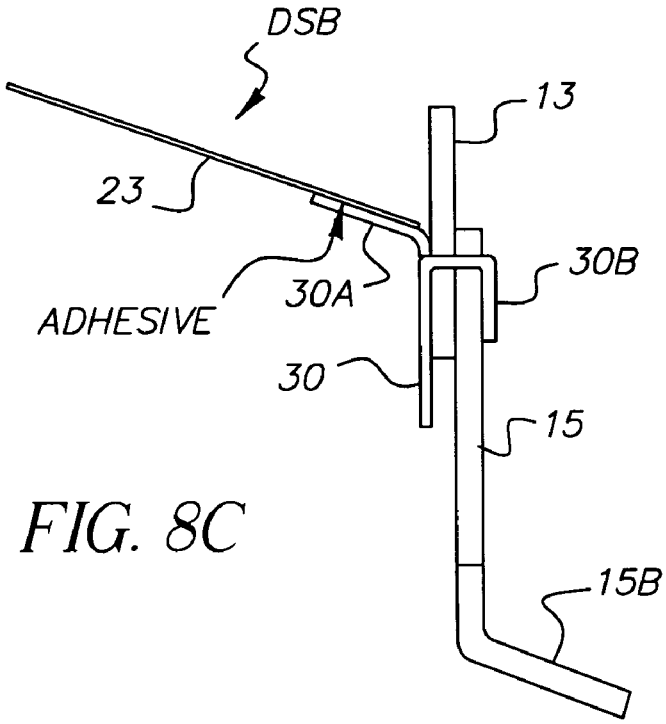
Figure 8D:
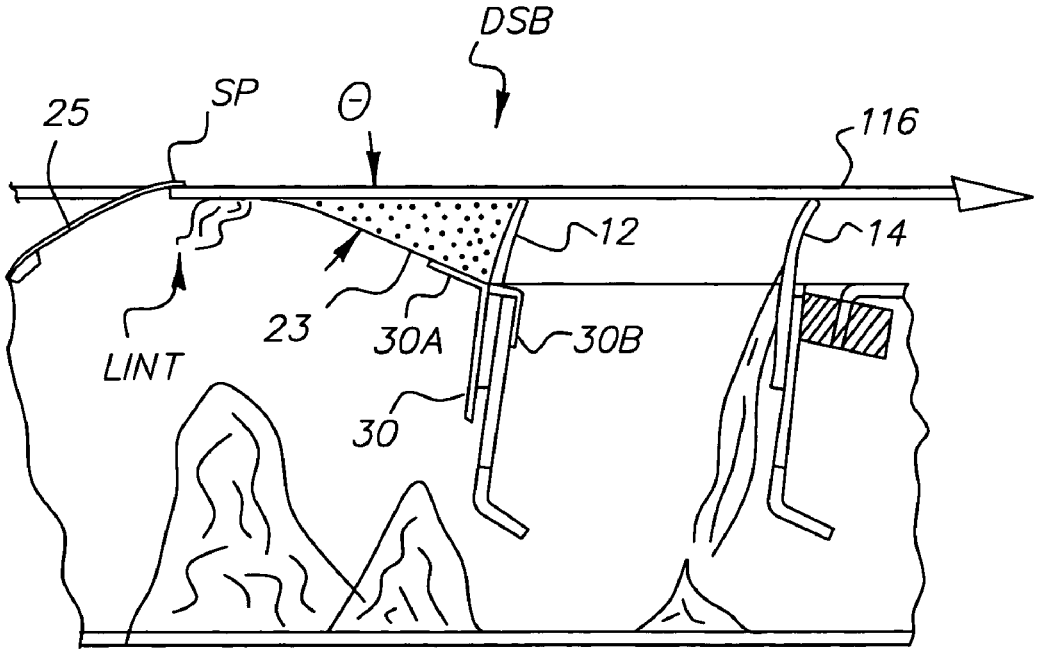

The dust seal blade 23 material can be Mylar®, PET (polyethylene terephthalate), including nylon, polycarbonate, polyethylene, or other compatible material with a thickness in the range of 0.025 mm–0.100 mm, preferably in the range of 0.063 mm–0.089 mm to prevent waviness and sagging due to toner load in the cavity. The larger thickness range allows for more robustness of the part relative to operator mishandling and vacuum cleaning around the cleaner cartridge CRCC. However, if the dust seal blade 23 is too thick, it might remove more toner, and allow toner to compact in the cavity 24 which then would press the cleaning blade 12 away from the web 116 producing poor cleaning. The free extension of the dust seal blade 23 can be from 5 mm–19 mm and its angle θ with the outgoing web surface should be within 5°–35° The engagement e of the dust seal blade 23 with the web 116 (see FIG. 3) should be in the range of 0.75 mm–2.54 mm and its edge could in fact be curled away from the web surface due to the engagement to reduce its impact with the web splice SP. To avoid toner leakage at the ends of the cleaning blades 12 and 14, the length of the dust seal blade 23 should be less than that of the cleaning blade 12, preferentially shorter by about 10 mm–25.4 mm at both ends, and it should be centered with the cleaning blade 12 (FIG. 8A). This would allow toner in the cavity to fall into the cleaner reservoir R at the ends of the dust seal blade 23 (FIG. 8D). Additionally the upstream edge of the dust seal blade 23 should be spaced from the edge of the seal blade 25 in the lid assembly LA by 5 mm–25 mm.

The dust seal blade 23 works as a scraper blade against the web motion but its low stiffness, and preferred engagement angle prevent it from removing much of the incoming toner. The toner will collect and build up in the cavity 24 between the dust seal blade assembly DSB and the cleaning blade 12. The dust seal blade 23 is deflected from contact with the web 116 and the toner build up within the cavity 24 creates an obstruction to lint, allowing for the lint to be trapped and preventing the lint from reaching the cleaning blade 12. As more toner is introduced into the cavity 24, the toner is forced out of the cavity 24 into the sump housing 16, driving the lint down into the sump housing 16 (FIG. 8D) in the process. The invention provides other advantages, such as using the toner build up within cavity 24 to prevent incoming toner from becoming airborne, thereby reducing internal dusting, while simultaneously providing continuous lubrication to the edge of cleaning blade 12 extending the life of cleaning blade 12. Another advantage is that because there is always toner facing the web 116 excess oil that is on the web 116 can be absorbed into the toner particles within the cavity 24. Excess oil on the web 116 is a common form of contamination that especially occurs in two-sided printing. It should be noted that the dust seal blade 23 within the preferred embodiment is in a scraper configuration, and it is important that the splice SP on the web 116 allows the dust seal blade 23 to step down as it passes by the splice SP (FIGS. 3 and 8D). It is preferred, although not essential, that the cavity 24 be filled with toner. Additionally, it is recommended that periodically, and particularly during installation of the cleaner cartridge CRCC, a service routine be run to introduce toner to the web 116 to cover the length of the dust seal blade 23 or the cleaning blade 12. The cavity 24 can be filled with 5 g–15 g of toner depending on the configuration of the dust seal blade assembly DSB. Preferred service routines would include the formation of registration marks or process control patches, and using residual toner on the photoconductor webs or drums.

The foregoing discussion describes a single dust seal blade assembly used with one wiper blade of a dual blade cleaner. It will be readily understood by those skilled in the relevant arts, that this invention can be extended to use with single blade cleaner, multiple blades on an indexing roller, and against a web or drum, a stationary hardback up, or a roller.

As best shown in the exploded, perspective view of the CRCC shown in FIG. 6, sump housing 16 comprises a generally rectangular tray TR, preferably made of plastic and injection-molded, that defines a reservoir for receiving particulate material removed from the web 116. The tray TR has four mutually perpendicular flanges 16F by which it is supported by the support bracket assembly BA. These perpendicular flanges 16F support the mounting of a foam gasket 26 which will be compressed between the lid assembly LA and the sump housing 16 where these parts are attached. The foam gasket 26 should be placed flat over flanges 16F after the cleaning blades 12 and 14, the dust seal blade assembly DSB, and the baffle 20 have been installed into the sump housing 16. The material for foam gasket 26 should have a low density, a low compression set and high resiliency. R200/U polyester with a density of 2 lb/cubic feet is an example of a suitable material for foam gasket 26. The sump housing flanges 16F define the shape of foam gasket 26 to seal along their perimeter (see FIG. 3). The foam gasket 26 should be narrower than flanges 16F to minimize chances for gasket overhanging. The thickness of foam gasket 26 should be selected to minimize drag torque on the sheet-transport web 116 by the lid assembly elements.

The flanges 16F of the tray TR also feature sets of upstream tabs UT and downstream tabs DT that allow for locking of the lid assembly LA. The tray TR has a pair of opposing sidewalls 21, 22. Each sidewall defines a pair of notches 21A, 21B in sidewall 21, and notches 22A, 22B in sidewall 22. As indicated above, these notches 21A, 21B, 22A, 22B are shaped to support the extension tabs T extending axially from the respective ends of the cleaning blades 12 and 14. The notches 21A, 21B, 22A, 22B are located and oriented in the sidewalls 21, 22 to support the two cleaning blades 12, 14 in a spaced, parallel relationship, with blade elements 12B and 14B being arranged at an acute angle X (see FIG. 3) relative to the upper planar surface PS of a lid member 18 of the lid assembly LA. In use, the CRCC is supported (by the bracket assembly BA shown in FIG. 2) in an operative position with respect to the web surface such that the blades 12, 14 are arranged at the acute angle X relative to the oncoming web surface (i.e., the upstream portion of the web 116). Thus, the blade elements 12B, 14B will be supported in a "wiping" mode, as explained above.

The CRCC is configured so that no fasteners are needed to mount the baffle 20, cleaning blades 12 and 14, the dust seal blade assembly DSB on the sump housing 16, or the lid assembly LA to the sump housing 16 with the foam gasket 26 trapped in place. The blades 12, 14 are installed by simply dropping the extension tabs. T of the blades 12, 14 into the notches 21A, 21B, 22A, 22B of the sump housing 16; conversely, the blades 12, 14 are easily removed by simply lifting them out of their supporting notches 21A, 21B, 22A, 22B.

Blade-supporting notches 21A, 21B, 22A, 22B are arranged to produce a predetermined and desired wiping angle and interference with the surface to be cleaned. Preferably, the wiping angle is to be between 60° and 85°, and most preferably about 80°. The amount of blade interference Z with the web surface (shown in FIG. 3) depends on the stiffness of the blade and the desired load in order to clean contaminants from the web 116. In general, this blade interference Z can be between 0.254 mm and 2.54 mm, and is preferably between 0.254 mm and 1.524 mm, and a normal load is within the range of from 10 g/cm–60 g/cm. It is contemplated that it may be desirable to set the first blade 12 at a lower load so that it functions primarily as the cleaner of the bulk of the toned patches and trapper of lint, paper dust, and oil, while the second blade 14 is set at a higher load to complete the cleaning operation. This result can be achieved by making adjustments to the cleaning blades 12, 14 (e.g., by varying the thickness t, width w, or material of the flexible wiper elements 12B, 14B) and/or by varying the depth of the blade-supporting notches 21A, 21B, 22A, 22B in the sump housing 16. In this embodiment, it is preferred that both blades 12, 14 are set at the same load. A preferred spacing between the two cleaning blades 12, 14 is between 0.635 mm and 20 mm to reduce any chance of toner spilling while allowing enough room for particles to flow down into the sump housing 16.

Figure 9:
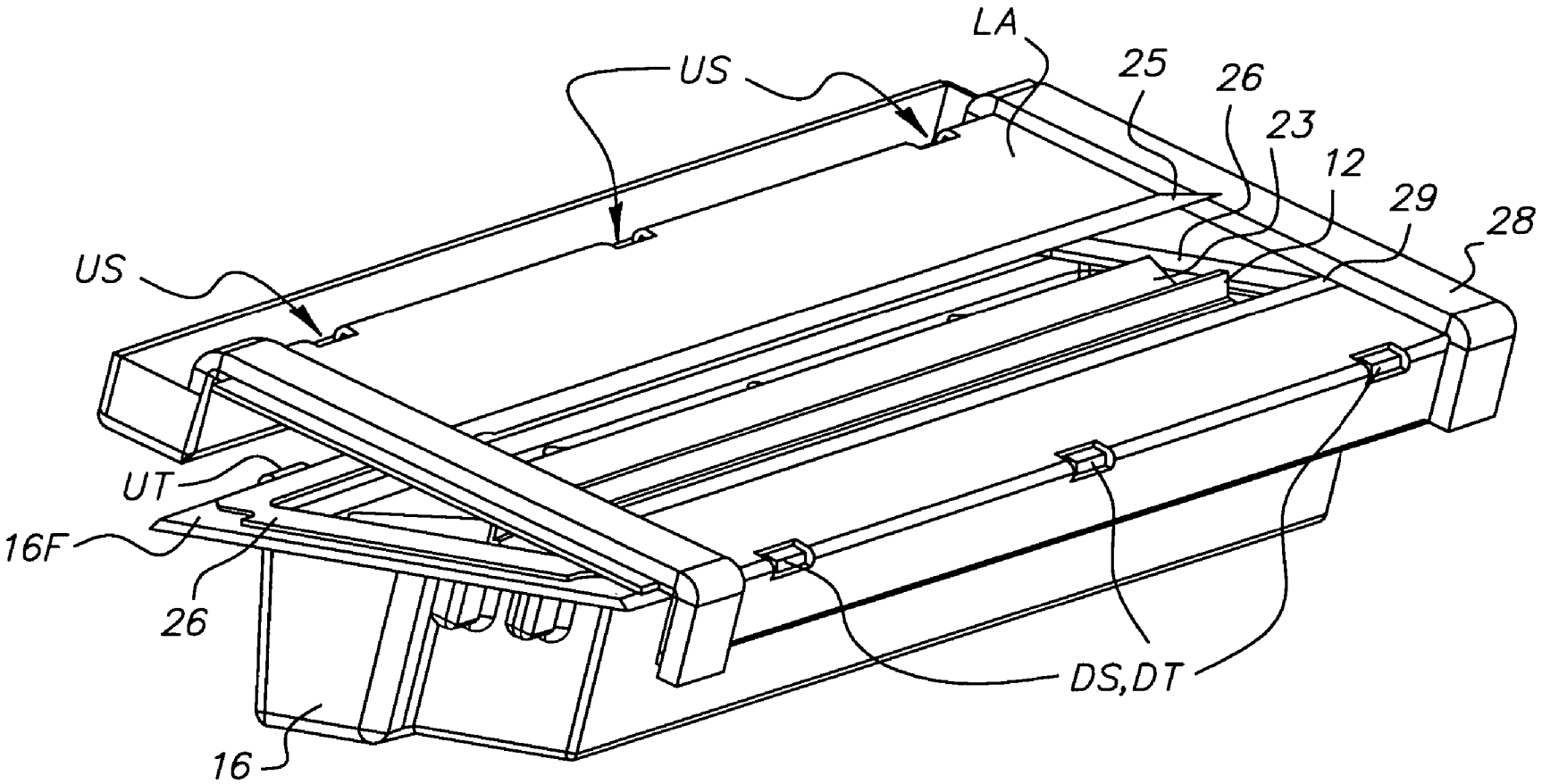
FIG. 9 is a perspective view of the lid assembly facilitating understanding of the mounting procedure to the rest of the cleaner with the tabs and slot features.

The multi-purpose lid assembly LA includes the lid member 18 that cooperates with the sump housing 16 to provide an enclosed chamber for particulate material scavengd from the web 116. Lid member 18 is preferably fabricated from a static-dissipative plastic maferial; it may, however, be made of a lightweight metal, such as aluminum or even steel. Preferably, the lid member 18 is configured to snap onto the top of the sump housing flanges 16F by insertion of the lid downstream slots DS over the longer downstream tabs DT of the sump housing flange 16F. By shifting the lid member 18 over to the upstream side and then rotating the lid member 18 down until the upstream slots US snap into the narrower upstream tabs UT at the sump housing flange 16F, and over the foam gasket 26 which had been placed flat over the sump housing flanges 16F, (FIG.9). While the preferred embodiment employs three tabs on each side of the sump housing 16 as shown, other combinations of tabs and mating slots may be used to accomplish the locking function without fasteners. To remove the lid assemhly LA, the lid assembly LA must be shifted toward the upstream side of the sump housing 16, and the sump housing 16 should be squeezed at the center of the TR to allow the tabs UT to retract from the slots US at the upstream side. Another removal technique is to press on the upstream tabs UT against the slots US while pulling the tray TR down from the lid assembly LA. The upstream tabs UT are narrower than downstream tabs DT, however they all have the same width and the same thickness. The upstream tabs are UT are fabricated to have ramped edges in order to facilitate the snap on attackment of the lid assembly LA.

As shown in FIG. 6, lid member 18 has a substantially planar top surface PS in which a substantially rectangular opening 18B is formed. Blade elements 12B and 14B of the cleaning blades 12, 14 project though this opening 18B when the blades 12, 14 are seated in the sump housing 16. A flange 18C, best shown in FIG. 3, extends downwardly from the downstream edge of opening 18B and serves to provide backup support for a foam seal 29 located behind the second cleaning blade 14. Foam seal 29 operates to seal the downstream end of the cartridge from loss of scavenged particles through opening 18B behind the second cleaning blade 14. Foam seal 29 does not contact the moving web 116 and it should be separated from the web 116 by at least 1.9 mm to prevent possible toner recontamination due to slight build up of toner from the collisions of the blade, elements 12B, 14B with the splice SP in web 116. Foam seal 29 should also be compressed against the stiffening plate 15 of the second cleaning blade 14 by 20%–35%; it is attached to flange 18C by use of an adhesive layer on one of its sides and wrapped around the edges of flange 18C. The preferred foam seal material should have low density, low compression set, and high resilience, such as R200/U polyester having a density of 2 lb/cubic foot.

A second flange 18D extending upwardly from the upstream edge of opening 18B at an angle Y serves to support the thin, flexible seal blade 25 that projects upwardly from lid member 18, generally towards the dust seal blade 23. In addition to sealing the upstream end of the cartridge from a loss of scavenged particles during use, dust seal blade 25 also acts to deflect lint and toner build up in the cavity 24 of the dust seal blade assembly DSB toward and through the lid opening 18B and ultimately into the underlying sump housing 16. The gap between the free edge of seal blade 25 and the dust seal blade 23 is relatively narrow, preferably being between 5 mm and 25 mm in width, to minimize scavenged particle spillage or leakage. Seal blade 25 is relatively thin with a recommended thickness in the range of 0.025 mm to 0.100 mm, and preferably less than 0.085 mm, and extends from second flange 18D such that angle Y is relatively shallow (see FIG. 3), between 15° and 30°, relative to the web surface. At such an angle, the seal blade 25 has minimal effect on scavenging particulate material from the web 116. The seal blade 25 dimensions are selected to minimize waviness in the blade edge and its material can be Mylar®, polyester, nylon, polycarbonate, and polyethylene or other compatible material. The free extension of seal blade 25 (the part that extends beyond the edge of flange 18D) is preferably less than 25.4 mm to minimize waves but more than 2.54 mm to maintain flexibility for the prevention of particle scavenging. The preferred range of such free extension is between 5 mm and 19 mm. The seal blade 25 has an adhesive layer surface matching the outside surface of flange 18D. Flange 18D must be rigid and flat to minimize stress on adhesive and waviness in the seal blade 25. The engagement of the seal blade 25 with the transport web 116 over the shoe 40 is between 0.05 mm and 2.54 mm depending on the other parameters selected, such as free extension and thickness. Preferably, the forward end of lid member 18 is shaped to define an elongated cavity 19, extending across the entire width of the lid member 18, that operates as an auxiliary external sump adapted to collect and contain any particulate material that is deflected from the web upstream of the intended web-cleaning location (such as by seal blade 25).

Lid assembly LA further includes a pair of foam seals 27, 28 that are attached to lid member 18 at both sides adjacent to side walls 21, 22 of the sump housing 16. These seals 27, 28 serve both to minimize any leakage of scavenged particles out of the sides of the sump housing 16 during use of the cleaning apparatus, and to wipe particles from the sides of the web 116. Each seal 27, 28 has an adhesive on the side facing the lid member 18 and a wear-resistant fabric, (Nylon for example), on the side facing the web 116. The foam portion of the seal 27, 28 needs to be of high resiliency, low density, and a low compression set to maintain a good seal and to reduce any drag torque on the transport web 116. A preferred foam material is R200/U polyester having a density of 2 lb/cubic foot. The wear-resistant fabric also serves to reduce friction between the web surface and the seal 27, 28 and it provides some cleaning of the web surface not covered by the blades 12, 14.

Baffle 20 is made out of static dissipative plastic or metal such as aluminum or steel. Preferably, it is fabricated as a separate part to be installed into the sump housing 16 or it is fabricated as an integral part of the injection mold. The baffle 20 comprises a plurality of spaced walls 20A that are arranged at a common angle, between about 15° and 45°, relative to the sidewalls 21, 22 of the sump housing 16. Walls 20A serve to drive scavenged particles toward the upstream side of the sump housing 16 whenever the CRCC is dropped at the front for removal or servicing. The baffle 20 also extends from side to side of the reservoir, or as much as possible, and the walls 20A are higher in front of the first blade 12 since the reservoir has most storage capacity or volume in front of the first blade 12. Two baffle holes 20B are mated over protrusions 17 at the bottom of the sump housing 16 as shown in FIG. 3. After mating the baffle 20 in the protrusions 17, it may be desirable to heat stake them to lock the baffle 20 in place. This would facilitate remanufacturing, as the baffle 20 would not fall off the sump housing 16 as it is being prepared for reuse. However, for recycling operation, it may be better to not lock the baffle 20 in the sump housing 16 to allow for separation between plastic and metal parts.

A CRCC fabricated with the above features enables the replacement of worn out or damaged parts such as the cleaning blades 12, 14 the dust seal blade assembly DSB, or the lid assembly LA, while reusing the sump housing 16 and baffle 20. Waste toner could be disposed of into an anti-static plastic bag and sealed with a twist tie. These features would also enable recycling and remanufacturing of the cleaner components if needed.

Referring to FIG. 2, the shoe assembly SA includes a hard shoe 40 having a conductive, wear-resistant surface to avoid charge buildup. Shoe 40 provides hard backing to both cleaning blades 12, 14 Shoe assembly SA further includes a front bracket portion 42 with bores to receive for example locking bolts 46 to allow precise positioning of the CRCC with respect to the shoe 40, a latching function with respect to the bracket assembly BA, and a rear bracket portion 44 having slots that receive for example locking bolts 46' to provide precise positioning of the cleaner cartridge with respect to the shoe 40. The shoe assembly SA is positioned to the web frame F to allow the shoe 40 to generate some wrap with the transport web 116. The back-up shoe assembly SA is rigidly connected to the web-transport frame F by the series of locking bolts 46, 46'. The locking bolts 46' are readily received in open slots at the rear of bracket portion 44 that greatly facilitates the installation or removal of the shoe assembly SA since the locking bolts 46' need only be loosened to remove the shoe assembly SA and the bolts. 46' are arranged outwards the face of the rear of bracket portion 44 so the operator can easily see these fasteners. These features on the rear of bracket portion 44 are improvements in the assembly that allow the back-up shoe assembly SA to remain fixed in the printing machine.

Referring again to FIG. 4, the bracket assembly BA that supports the CRCC comprises a frame 50 having a rectangular opening 52 adapted to receive and support the CRCC's sump housing 16. The CRCC is installed in the bracket assembly BA by simply separating the bracket assembly BA from the back-up shoe assembly SA and dropping the sump housing 16 into opening 52. An edge feature 52A on frame 50 assures that the CRCC is received in the proper orientation so that the cleaning blades 12, 14 operate in a wiping mode.

While the invention has been described in detail with particular reference to a presently preferred embodiment, it will be understood that variations can be effected without departing from the spirit and scope of the invention.

PARTS LIST

100 document printer
103 image-forming member
104 cleaning brush
105 primary corona charger
106 laser scanner
107 magnetic brush applicator
108 image-transfer member
109 image-transfer nip
110 second image-transfer nip
111 cleaning brush
112 sheet-feed station
113, 114 web-transport rollers
116 sheet-transport web
121 transfer roller
124 corona charger
126 detack charger
129 conditioning charger
130 web-cleaning apparatus
141 electrically conductive drum
142 hard overcoat
143 compliant blanket
150, 152 power supplies
12, 14 cleaning blades
12B, 14B blade elements
13 flexible blade element
15 stiffening plate
15B bend in stiffening plate
16 sump housing
16F flanges on sump housing
17 protrusions on sump housing for mating with baffle
18 lid member
18B blade opening in lid member
18C, 18D flanges on lid member
19 cavity/auxiliary reservoir
20 baffle
20A baffle walls
20B baffle locating holes
21, 22 sidewalls of sump housing
21A, 21B, 22A, 22B blade-receiving notches
23 dust seal blade

24 dust seal blade cavity
25 front seal blade
26 foam gasket
27, 28 side seals
29 foam seal
30 dust seal blade bracket
30A tab on dust seal blade bracket
30B hooks on the dust seal blade bracket
40 hard shoe
42, 44 front and rear bracket portions
46, 46' locking bolts
50 bracket assembly frame
52 frame opening for CRCC
52A edge features
D densitometer
F web transport frame
M motor
R reservoir
S image-receiver sheets
t blade thickness
T blade extension tabs
w blade width
X angle between PS and blade elements
Y seal blade mounting angle
Z blade interference with web surface
BA bracket assembly
LA lid assembly
SA shoe assembly
PS planar surface on lid member
TR tray
TP toner patches
SP splice on sheet-transport web
CRCC customer-replaceable cleaning cartridge
UT upstream tabs on sump housing for mating with US
DT downstream tabs on sump housing for mating with DS
US upstream slots on lid member
DS downstream slots on lid member
DSB dust seal blade assembly
θ dust seal blade angle with web
e dust seal blade engagement with web

What is claimed is:

1. A cleaning cartridge adapted for use in a web-cleaning apparatus for removing particulate material from a surface of a moving web, said cartridge comprising:

at least one cleaning blade having an elongated rigid member with a rectilinear edge and a flexible blade element extension; and a dust seal blade assembly mounted to said at least one cleaning blade, said dust seal blade assembly having a flexible dust seal blade element and an attachment mechanism that removeably secures said dust seal blade element to said at least one cleaning blade.

2. The cleaning cartridge of claim 1, wherein said attachment mechanism further comprises a pair of hook-like features receivable by said at least one cleaning blade for easy attachment of said dust seal blade element to said at least one cleaning blade.

3. The cleaning cartridge of claim 1, further comprising a sump housing for receiving and storing particulate material, said sump housing having opposing side walls with a first set of features shaped to receive and support said at least one cleaning blade therebetween in a predetermined position.

4. The cleaning cartridge of claim 3, further comprising a lid assembly in removable secured relation with said sump housing to form an enclosed chamber with said sump housing, said lid assembly comprising a lid member having a substantially planar upper surface with an elongated opening through which said flexible dust seal blade element of said at least one cleaning blade projects, and said lid assembly further comprising a second set of features that mate with said first set of features of said sump housing side walls.

5. The cleaning cartridge of claim 1, wherein said dust seal blade element and said at least one cleaning blade define a cavity, such that toner cleaned from said moving web can be retained within said cavity.

6. The cleaning cartridge of claim 1, wherein said dust seal blade assembly has a tab feature to position said dust seal blade element at an angle of 5°–35° with an outgoing portion of said moving web.

7. The cleaning cartridge of claim 1, wherein said dust seal blade element has a thickness in the range of 0.025 mm–0.100 mm, and preferably in the range of 0.063 mm–0.089 mm, a free extension in the range of 5 mm–19 mm and forming an angle with an outgoing portion of said moving web of 5°–35°.

8. The cleaning cartridge of claim 1, wherein said dust seal blade assembly further including a bracket is made of nonmagnetic steel with a thickness range of 0.75 mm–2.54 mm and has hooks at both ends to allow for easy installation and replacement onto said at least one cleaning blade.

9. The cleaning cartridge of claim 1, wherein said dust seal blade element is shorter than the length of said at least one cleaning blade by a range of 10 mm–25.4 mm at both ends.

10. The cleaning cartridge as defined by claim 1, further comprises a seal blade contacting said moving web, and located in an upstream direction relative to said dust seal blade element, wherein said dust seal blade element is separated from said seal blade by 5 mm–25 mm.

* * * * *